United States Patent [19]

Stansberry

[11] Patent Number: 4,771,863

[45] Date of Patent: Sep. 20, 1988

[54] SAW HORSE CONSTRUCTION

[76] Inventor: Robert F. Stansberry, 18584 Fitzpatrick, Detroit, Mich. 48228

[21] Appl. No.: 104,090

[22] Filed: Oct. 5, 1987

[51] Int. Cl.[4] ..... B27B 21/00

[52] U.S. Cl. ..... 182/155; 182/181; 182/225

[58] Field of Search ..... 182/155, 181–185, 182/224, 225

[56] References Cited

U.S. PATENT DOCUMENTS

| | | | |
|---|---|---|---|
| 932,702 | 8/1909 | Harris | 182/155 |
| 1,150,938 | 8/1915 | Hensley | 182/155 |
| 1,377,095 | 5/1921 | Rupp | 182/155 |
| 1,823,871 | 9/1931 | Beasley | 182/155 |
| 4,152,834 | 5/1979 | Stansberry | 182/155 |
| 4,296,834 | 10/1981 | Kroger | 182/155 |

*Primary Examiner*—Reinaldo P. Machado

*Attorney, Agent, or Firm*—Shoemaker and Mattare, Ltd.

[57] ABSTRACT

An improvement in saw horse construction, of the erectable type, and which makes use of a small link chain connection between next adjacent legs of the saw horse, at each end, and a member which is fastened to the chain connection and serves as a diagonal brace by having its opposite end adapted for wedge-locked engagement with the underside of the main support member of the saw horse for holding the saw horse legs erected and also allowing them to be easily collapsed.

5 Claims, 1 Drawing Sheet

SAW HORSE CONSTRUCTION

BACKGROUND OF THE INVENTION

Saw horses that are used by carpenters and handymen and as are most commonly known, are usually made out of two-by-four lumber nailed together to provide a horizontal cross member with a pair of outwardly spread legs at each end.

The legs, at each end, extend down and are spread outwardly and they usually have a cross brace between them and another bracing member that extends between the two cross braces to hold the legs spread apart and rigid. And, the bracing members are most frequently also made out of two-by-four lumber.

This type of construction is very sturdy and permanent, but it is not too good for the handyman or person who only occasionally needs to use a saw horse because of their massive size and considerable weight.

What these people need is a saw horse that can be erected for use when needed but otherwise can be collapsed and folded away for storage. And, one which is reasonably light in weight, but still sturdy and dependable in construction; that is self contained with no separate parts that might be lost and which is sufficiently simple in construction that it can be manufactured inexpensively, sold at a reasonable price and put-up or taken-down by almost anyone without written instructions or any appreciable mechanical skill or ability.

And, in such regard, there is just such a saw horse that is made by J & S MANUFACTURING, of Detroit, Michigan and is sold under the tradename of EASY HORSE. And, which is covered by U.S. Pat. No. 4,152,834.

However, there are certain improvements in even this construction which makes for a better product.

SUMMARY OF THE PRESENT INVENTION

This invention relates to an improvement in the construction of saw horses of the type shown and described by the aforementioned U.S. Pat. No. 4,152,834.

In particular, this invention relates to a simplified construction of such a saw horse wherein the former means for locking and keeping the saw horse legs erected, which included a spring biased detent arrangement for each of the four legs, is eliminated and replaced by much more simple and less expensive means with an appreciable saving in manufacturing cost and greater ease in assembly and disassembly of the saw horse.

More specifically, the spring biased detent arrangement for each of the four legs is eliminated, as mentioned, leaving just the small link chain connection between the next adjacent legs at each end of the saw horse. Then, a bracing member is fastened to the chain connnection, mid-way between the two legs, so that it can be extended upwardly and wedge-locked into engagement with the underside of the main horizontal member of the saw horse and cause the two supporting legs to be spread outwardly and held erect and ready for use. At the same time, the brace member is capable of being released later to allow the legs to be collapsed and folded into the main horizontal member and the whole assembly to be compactly folded down and together.

Figure 1:
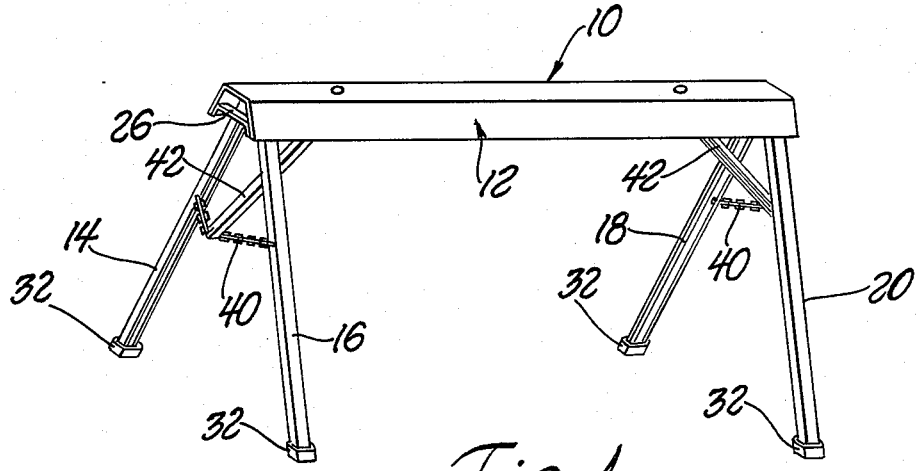
FIG. 1 is a perspective view of the saw horse of this invention as erected and ready for use.

DETAILED DESCRIPTION OF THE ILLUSTRATED EMBODIMENT:

As shown in the first drawing figure, the saw horse 10 of the present invention includes a horizontal or cross member 12, with a pair of supporting legs 14, 16 at one end and 18, 20 at the other end.

The main structural member, that serves as the horizontal cross member, 12, is formed of a heavy gauge sheet metal to an open channel form as shown best in the second drawing figure. And, it will be noted that the side flanges 22, 24 are spread outwardly and down so that the legs 14, 16, 18 and 20 will assume a like outwardly spread and downwardly extended disposition when erected for use.

A corner tie or strap 26 is fastened as by rivet means 28 between the lower corner ends of the flanges 22 and 24, at each end of the cross member 12, to provide added structural rigidity in the cross member and also to serve as an outer limit stop for the supporting legs, when they are erected. And, in this latter regard, the tie straps are made more rigid by having a slightly wider mid-section that is turned down, as at 30, and which also provides a space at each end of the tie straps within which the legs are received when they are erected.

The saw horse legs 14, 16, 18 and 20 are all exactly alike; being formed to a channel shape in cross section, for the added strength such a structural shape and form provides.

Each of the four legs is fastened to the cross member 12 by a rivet pin 33 that enable them to be pivotal on the cross member. And they are fastened to the downwardly and outwardly spread flanges 22 and 24 of the cross member, at each end, so that they assume an outwardly spread disposition when erected. They also each have a molded plastic boot or shoe 32 provided on their lower extremity; for better ground gripping engagement without floor damage.

Figure 2:
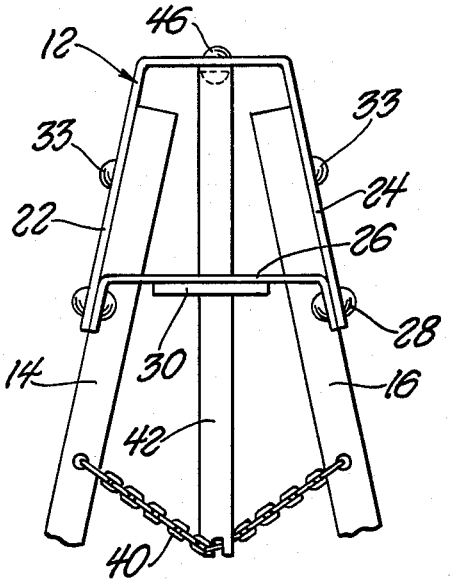
FIG. 2 is an end view of the saw horse shown in the first drawing figure; enlarged to better show certain details of construction.
Figure 3:
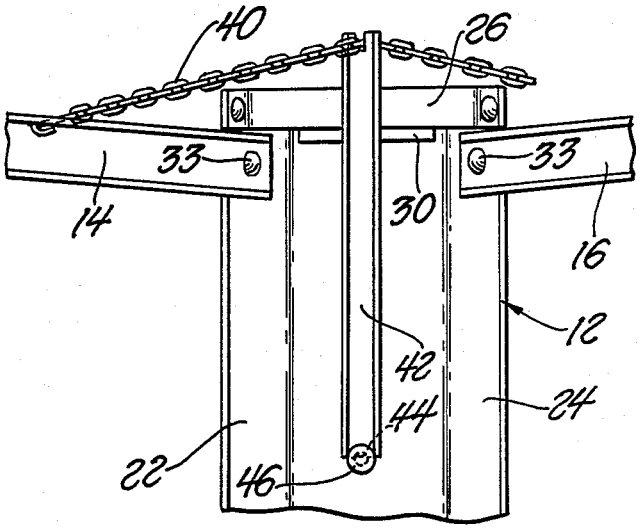
FIG. 3 is a bottom or underside view of one end of the erected saw horse showing how the member that serves as a diagonal brace is engaged to the underside of the horizontal member and forces the saw horse legs to be spread outwardly and held in position.
Figure 4:
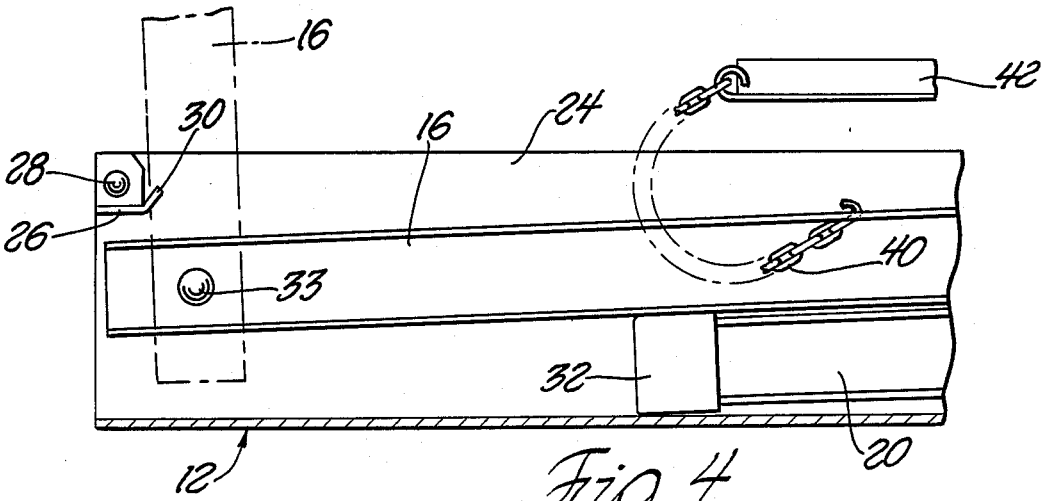
FIG. 4 is a further enlarged cross-sectional view of one end of the horizontal member of the saw horse with the saw horse legs folded into it, for storage, and one of the legs shown in dotted outline as opened and positioned for use.

As shown in FIGS. 1–3, the legs are pinned to the ends of the cross member 12 on the insides of the side flanges 22 and 24 so that they can be swung open and will assume an outwardly spread disposition. And in FIG. 4 they are shown as folded down into the larger channel shape of the cross member and nested one over the other from opposite ends of the cross member.

Referring now to the means for holding the legs erected;

A short piece of small link chain 40 is shown as fastened to each pair of the legs 14, 16 and 18, 20, a short distance down each leg, and at each end of the saw horse. Essentially, this serves as a means for keeping the two legs that it is connected to from being spread too far apart and putting undue pressure on the rivet pin connection that fasten the legs to the cross member 12.

A small bar or rod 42, channel shaped for strength and simplicity, is fastened to the short piece of chain between the two legs and has its other end formed for engagement with the underside of the main cross member of the saw horse.

As such, it is intended to serve as a diagonal bracing member to force and hold the saw horse legs spread outwardly to the limits afforded by the tie straps 26 at each end of the main cross member. And, its means of engagement with the underside of the main cross member consists simply of having a notch 44 in its end which is engaged with a rivet pin 46 provided on the cross member, back a short distance from its outer end.

When the saw horse legs are being erected, they are swung outwardly to the limits afforded by the tie strap 26 at each end of the cross member 12 and the chain connection 40 is stretched between them. Then the brace member 42, which is connected to the short length of chain between the two legs, is swung up and forced outwardly, against the resistance of the chain, and its other end, with the notch 44, is caused to be engaged with the rivet pin 44 on the underside of the cross member. And, in so doing, the member 42 serves to hold and tension the saw horse legs in their erected disposition.

To fold or collapse the saw horse down for storage, the brace member 42 is disengaged from the rivet pin on the underside of the cross member, by simply pushing outwardly against the resistance of the chain connection 40 and swinging its free end down. Then, the legs are swung inwardly, down into the open channel shape of the cross member, each against the side wall 22 or 24 to which they are engaged, and with the legs from opposite ends nested one over the other; as is shown with legs 16 and 20 in the last drawing figure.

The bracing members 42, being connected to the chain between next adjacent legs at each end of the saw horse, simply lay down in the channel shape of the cross member with the supporting legs, and are safe from loss.

Claims of the patent:

1. A saw horse construction, comprising:

a sheet metal member channel shaped in cross-section and having depending and divergently spread side wall flanges;

a pair of legs pivotally engaged to said side wall flanges at each end of said sheet metal member;

a foldable strap means connected between the next adjacent legs at each end of said sheet metal member for keeping said legs from being spread too far apart and for allowing said legs to be folded down into said sheet metal member for storage and to be erected for use as and when desired;

a rigid brace member having opposite ends and being connected at one end to said strap means between the ends of the strap means and having a notch in its other end; and a depending abutment on the underside of said sheet metal member for engaging in said notch in said brace member to support said brace member and hold said legs erected for use and for the release thereof to allow said legs to be folded down into said sheet metal member for storage.

2. The saw horse construction of claim 1, including; said means being a small link chain.

3. The saw horse construction of claim 2, including;

a tie strap fastened between said divergently spread side wall flanges at each end of said sheet metal member and serving as a stop for said legs as erected.

4. A saw horse construction, comprising:

a sheet metal member channel shaped in cross-section and having depending and divergently spread side wall flanges;

a pair of legs pivotally engaged to said side wall flanges at each end of said sheet metal member;

a small link chain connected between the next adjacent legs at each end of said sheet metal member and for allowing said legs to be folded down into said sheet metal member for storage and to be erected for use as and when desired;

a tie strap fastened between said divergently spread side wall flanges at each end of said sheet metal member and serving as a stop for said legs as erected;

a bracing member having structural strength and rigidity and having opposite ends, one end of said bracing member being connected to said chain between the ends of said chain and the other end of said bracing member having a notch therein; and a depending pin provided on the underside of said sheet metal member and adapted to engage in said notch in said bracing member end to releasably support said bracing member, whereby said bracing member applies tension to said chain and holds said legs erected for use when the ends of said bracing member are engaged with the chain and the pin, respectively, and said bracing member end may be disengaged from said pin to enable said legs to be folded into said sheet metal member for storage.

5. A saw horse construction, comprising:

a sheet metal member channel shaped in cross-section and having depending and divergently spread side wall flanges;

a pair of legs pivotally engaged to said side wall flanges at each end of said sheet metal member;

means connected between the next adjacent legs at each end of said sheet metal member and for allowing said legs to be folded down into said sheet metal member for storage and to be erected for use as and when desired;

a bracing member having opposite ends and being connected at one end thereof to said last mentioned means and having a notch in its other end; and a depending pin on the underside of said sheet metal member for engaging in said notch in said bracing member to support said bracing member and hold said legs erected for use and for the release thereof to allow said legs to be folded down into said sheet metal member for storage.

* * * * *